United States Patent [19]

Knoke

[11] 4,135,266

[45] Jan. 23, 1979

[54] ADJUSTABLE BED FRAME

[75] Inventor: Silas J. Knoke, Seymour, Ind.

[73] Assignee: Lear Siegler, Inc., Santa Monica, Calif.

[21] Appl. No.: 785,079

[22] Filed: Apr. 6, 1977

[51] Int. Cl.[2] ..... A47C 19/00

[52] U.S. Cl. ..... 5/201; 5/181; 5/176 R; 5/200 R

[58] Field of Search ..... 5/176 R, 181, 201, 202

[56] References Cited

U.S. PATENT DOCUMENTS

| | | | |
|---|---|---|---|
| 2,784,421 | 3/1957 | Fredman | 5/201 |
| 3,100,304 | 8/1963 | Brandlin et al. | 5/176 R |
| 3,945,064 | 3/1976 | Harris et al. | 5/181 |

*Primary Examiner*—Casmir A. Nunberg

*Attorney, Agent, or Firm*—Reising, Ethington, Barnard, Perry & Brooks

[57] ABSTRACT

An adjustable angle iron bed frame has interfitting end rails which are retained in preadjusted assembled positions by generally U-shaped wire clips which extend diagonally through the respective backs and sides of the interfitted end rails to capture the inner and outer rails together in predetermined adjusted position.

6 Claims, 5 Drawing Figures

FIG-1
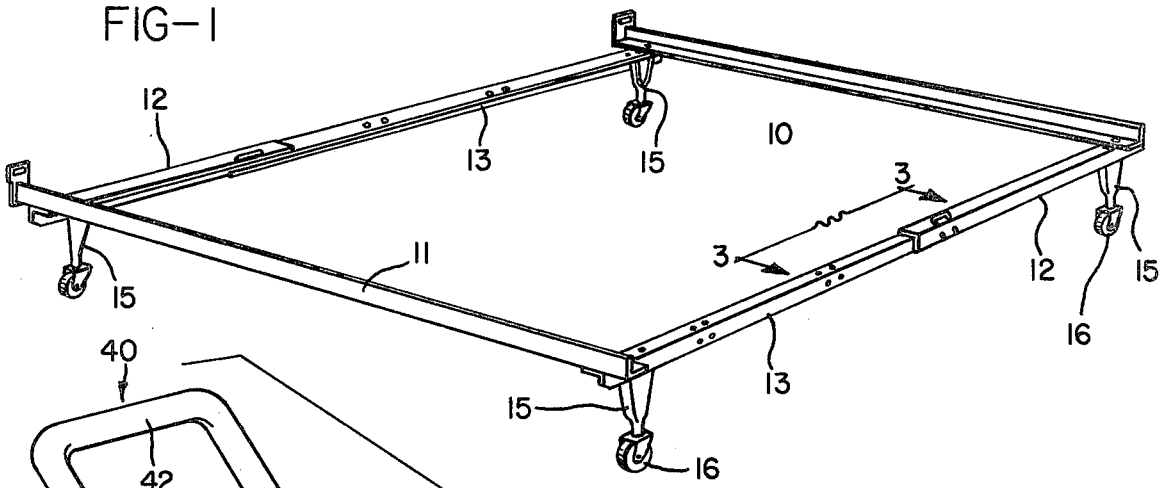
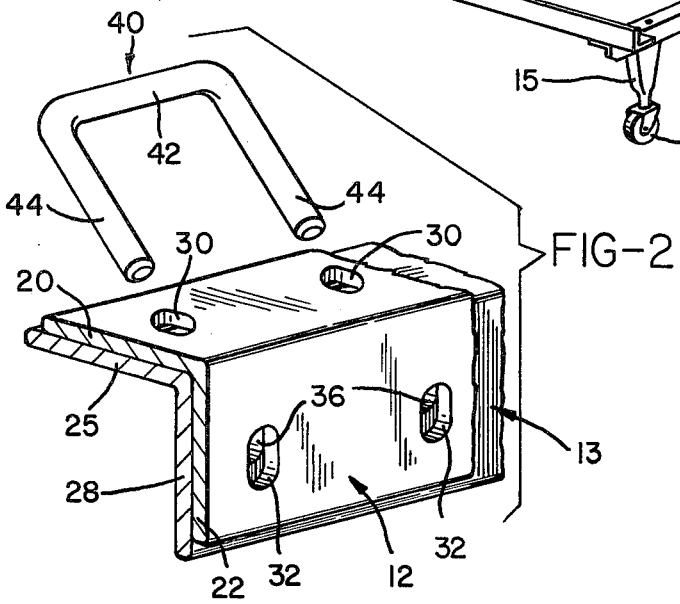
FIG-2
FIG-4
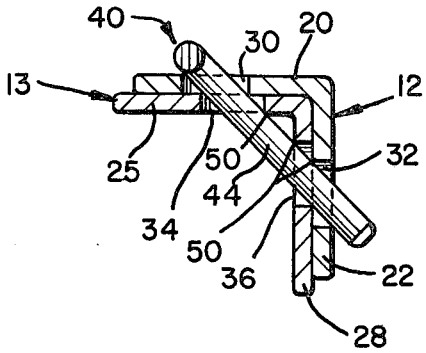
FIG-3
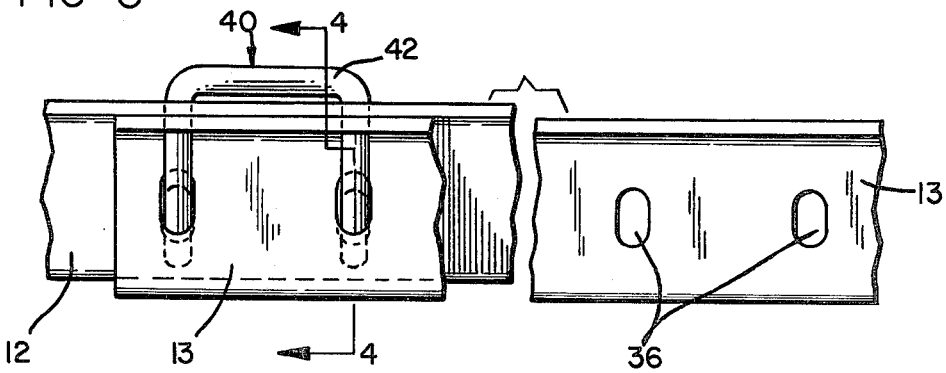
FIG-5
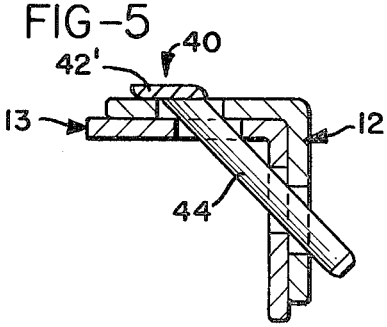

ADJUSTABLE BED FRAME

BACKGROUND OF THE INVENTION

This invention relates to adjustable folding bed frames of the Hollywood type in which the end rails are formed from angle iron material. The end rails are pivotally attached to their respective side rails and are adjustably interfitted or connected one with the other and secured by a locking or attaching means at preselected, spaced-apart widths of the side rails.

SUMMARY OF THE INVENTION

The invention is directed to low cost bed frames of the general type described above in which angle iron end rails are interfitted in adjustable overlapping relation, and a retainer pin member is extended diagonally through the rails, through openings or slots formed in the horizontal and depending legs of the interfitted end rails, for retaining and locking the rails in an adjusted position. In the preferred form of the invention, the locking pin member is a generally U-shaped clip, in which the back of the clip rests on the upper surface of the outer rail with the parallel legs thereof extending diagonally through openings formed in the rails, with the ends of the legs extending outwardly of the outer surface of the outer rail.

An advantage and object of the invention resides in the provision of a highly simplified, effective, self-locking retainer which captures the interfitted rails, which provides support against separation of the rails by reason of a weight applied thereto, and prevents disengagement or lateral movement of the rails one to the other.

The invention is characterized by its simplicity, low cost, ease of manufacture, and ease of use.

These and other objects and advantages of the invention will be apparent from the following description, the accompanying drawings and the appended claims.

BRIEF DESCRIPTION OF THE DRAWINGS

FIG. 1 is a perspective view of a bed frame according to this invention;

FIG. 2 is an enlarged fragmentary perspective view of the rail securing and retaining arrangement with the U-shaped retainer being shown prior to insertion within the aligned openings of the interfitted end rails;

FIG. 3 is a fragmentary elevational view looking generally along the line 3—3 of FIG. 1;

FIG. 4 is a vertical section taken generally along the line 4—4 of FIG. 3; and FIG. 5 is a section similar to FIG. 4 showing a modified construction.

DESCRIPTION OF PREFERRED EMBODIMENTS

Referring to FIG. 1, a Hollywood type folding bed frame is illustrated as including a pair of angle iron side rails 10 and 11 which are conventionally turned to face inwardly toward each other, to receive a box spring therebetween in the conventional manner. Each of the side rails 10 and 11 pivotally support a pair of angle iron end rails including an outer end rail 12 at one end and an inner end rail 13 at the other. The end rails, in turn, support legs 15 on which may be mounted castors 16.

The end rails 12 and 13 are pivoted toward each other and generally parallel to the associated side rail for shipping, but are extended to the right angle position shown in FIG. 1 for set up. The end rails usually provide adjustment for the standard widths of bedding, namely 3/3, commonly known as twin size, 4/0, commonly known as three-quarter size, 4/6, commonly known as full size, and 5/0, commonly known as queen size. Also, two complete frames may be positioned side-by-side at the 3/3 size to support twin beds on a king size headboard.

In low cost bed frames of the type shown, generally angle iron end rails as well as angle iron side rails are used. These rails are formed from rerolled railroad rails and are generally of lower cost as compared to the channel shaped rails used in high quality bed frames of the type shown in U.S. Pat. No. 3,871,039. Such angle iron material has found utility in the manufacture of bed frames since it is not only of relative low cost but has high strength. Since angle iron material inherently lacks support against forces tending to separate the rails, it is necessary to provide a simple and easy-to-use and low cost fastener arrangement by which the interfitted end rails may be supported and retained in predetermined adjusted width position.

The invention of this application uniquely solves the problem of securing the end rails together in adjusted position in a low cost and dependable manner. For this purpose, reference may be had to the views of FIGS. 2 through 4 in which the outer rail 12 is shown as having an upper generally horizontal leg 20 and a right angled depending leg 22. The inner end rail 13 associated with the opposite side rail is shown as having an upper generally horizontal leg 25 in underlying relation to the corresponding leg 20 of the rail 12 and also has a depending leg 28 which is positioned adjacent the corresponding leg 22.

A transversely spaced pair of elongated access openings or slots are defined in the horizontal leg 20. These slots 30 are transversely aligned with a corresponding pair of elongated openings or slots 32 formed in the depending leg 22 as shown in FIGS. 2 and 4. The openings or slots 30 and the slots 32 define in effect diagonally aligned pairs of openings in the outer rail 12. The inner rail is formed with groups of slots or openings and thus, the inner rail is provided with pairs of slots 34 in the horizontal leg 25 and pairs of slots 36 in the depending leg 28. The transverse spacings of the pairs of slots 34 and 36 in each of the groups is the same as that of the slots 30 and 32. However, the slots 34 and 36 are offset inwardly somewhat closer to the corner of the rail than are the slots 30 and 32 of the outer rail, so that there is formed generally diagonally aligned slots through the interfitted rails 12 and 13. The slotted openings may be conveniently formed in a punching operation.

The invention further includes means defining a pin member which extends diagonally at an angle of about 45° to the legs from a position above the leg 20 of the outer rail 12 through the aligned openings 30, 34, 36 and 32, in that order, and terminating at a position outwardly of the depending leg 22, for the purpose of capturing the inner rail 13 in a predetermined longitudinal position, with respect to the outer rail 12. This pin member in the preferred embodiment is constructed in the form of a U-shaped clip 40 having a transverse cylindrical back 42 and a pair of parallel extending cylindrical legs 44. For each adjusted position of the side rails there are provided transversely aligned pairs of openings to accommodate and receive the legs providing for insertion of the same therethrough in the manner shown in FIG. 4.

It is within the scope of the invention to use only a single headed pin member and a single group of aligned slotted openings for this purpose. The U-shaped clip 40 is preferred in that it provides a pair of legs 44 for more positive locking and retention of the end rail. It will be seen that when the clip 40 is inserted as shown in FIGS. 3 and 4, the back 42 is positioned in overlying relation to the horizontal leg 20 of the outer rail 12 and the legs 44 thereof extend through the aligned openings and terminate at a position outwardly of the depending leg 22. The clip 40 is self-supporting by its own weight in this position, and is further supported by reason of the overlying bedding or box spring on the bed frame.

Since the legs 44 of the clip 40 extend diagonally completely through the interfitted rails, the inner rail 13 is effectively captured and retained. Downwardly applied forces on either of the rails 12 and 13 only tend to lock these rails tighter against the legs of the clip 40. This self-locking feature is enhanced further by the fact that the individual slotted openings are cut squarely through the associated legs, leaving right angled corners 50 which embed themselves in, and tend to grip, the round legs 44 of the pin 40 when a downward or outward separating force is applied to one or both of the end rails. The frame is shown in FIG. 1 at its maximum width. For width adjustment it is a simple matter to remove the weight from the end rails, extract the clip 40, align the desired group of openings on the inner rail with the openings in the outer rail, and reinsert the clip.

Preferably the back portion 42 of the clip 40 is flattened as shown at 42' in FIG. 5 to minimize its upward projection about the leg 20 of the rail 12, but the cylindrical form shown in FIGS. 2–4 is also a practical embodiment.

While the forms of apparatus herein described constitute preferred embodiments of this invention, it is to be understood that the invention is not limited to these precise forms of apparatus, and that changes may be made therein without departing from the scope of the invention.

What is claimed is:

1. In a bed frame having adjustable angle iron end rails, the improvement comprising an outer end rail having an upper generally horizontal leg and a depending leg, and an inner end rail having a portion thereof interfitted in overlapping relation to said outer end rail, and also having an upper generally horizontal leg in underlying relation to the corresponding leg of the outer rail and having a depending leg positioned adjacent the corresponding leg of the outer rail, and means in each of said upper horizontal legs and depending legs defining aligned openings with the openings formed in each of said upper and depending legs being in general transverse alignment with each other, and a retaining pin member extending diagonally from a position above the horizontal leg of said outer rail through said aligned openings and terminating at a position outwardly of the depending leg of said outer rail to capture said inner rail in predetermined longitudinal position with respect to said outer rail.

2. The bed frame of claim 1, in which said pin member is aligned at about 45° to said legs.

3. The bed frame of claim 1 further comprising a second said set of aligned openings in said rails spaced longitudinally on said rails from said first set, and in which said pin member further comprises a generally U-shaped clip having a back and having a pair of legs with said back being positioned in overlying relation to the outer surface of the upper leg of the outer rail with the legs thereof extending through said aligned pairs of openings and terminating outwardly of the depending leg of said outer rail.

4. In a bed frame having adjustable angle iron end rails, the improvement comprising an outer end rail having an upper generally horizontal leg and a depending leg, and an inner end rail having a porton thereof interfitted in overlapping relation to said outer end rail, and also having an upper generally horizontal leg in underlying relation to the corresponding leg of the outer rail and having a depending leg positioned adjacent the corresponding leg of the outer rail, and means in each of said upper horizontal legs and depending legs defining longitudinally spaced pairs of aligned slot-like openings, with the pairs of said openings in said upper and depending legs of each of said end rails being in transverse alignment with each other, and a generally U-shaped retaining clip having a back in overlying relation to the outer surface of the horizontal leg of said outer end rail and further having a pair of leg members extending respectively through aligned openings in said rails diagonally from a position above the horizontal leg of said outer rail and terminating outwardly of the depending leg of said outer rail, to effectively capture and support said inner rail in predetermined longitudinal position with respect to said outer rail.

5. The bed frame of claim 4 in which said back is flat and is in a plane parallel to the outer surface of the horizontal leg of said outer end rail.

6. The bed frame of claim 1 wherein each of said openings in each of said legs extends through the leg at a right angle thereto whereby each of the openings has right-angled edges which make gripping contact with the pin extending through the aligned openings when downward force is applied to the end rails.

* * * * *